US010329753B2

(12) United States Patent
Thompson

(10) Patent No.: US 10,329,753 B2
(45) Date of Patent: Jun. 25, 2019

(54) MOTORIZED PIPE-MOUNTED DRAIN CLEANOUT

(71) Applicant: Perry Edward Thompson, Matlock (CA)

(72) Inventor: Perry Edward Thompson, Matlock (CA)

( * ) Notice: Subject to any disclaimer, the term of this patent is extended or adjusted under 35 U.S.C. 154(b) by 191 days.

(21) Appl. No.: 15/454,081

(22) Filed: Mar. 9, 2017

(65) Prior Publication Data

US 2017/0321402 A1 Nov. 9, 2017

Related U.S. Application Data

(60) Provisional application No. 62/333,555, filed on May 9, 2016.

(51) Int. Cl.

| | |
|---|---|
| ***B08B 9/02*** | (2006.01) |
| ***B08B 9/04*** | (2006.01) |
| ***E03C 1/302*** | (2006.01) |
| ***B08B 9/045*** | (2006.01) |
| ***B08B 9/047*** | (2006.01) |

(52) U.S. Cl.
CPC ..... *E03C 1/302* (2013.01); *B08B 9/045* (2013.01); *B08B 9/047* (2013.01)

(58) Field of Classification Search
CPC ..... B08B 9/045; B08B 9/047
See application file for complete search history.

(56) References Cited

U.S. PATENT DOCUMENTS

| | | | | |
|---|---|---|---|---|
| 2,953,799 | A * | 9/1960 | Arnold | B08B 9/045 15/104.33 |
| 4,376,321 | A | 3/1983 | Dudley | |
| 4,388,741 | A | 6/1983 | Breon | |
| 6,578,590 | B2 * | 6/2003 | Leblond | A46B 13/001 134/138 |
| 8,826,483 | B2 * | 9/2014 | Rutkowski | B08B 9/0436 15/104.33 |
| 9,725,894 | B2 * | 8/2017 | Caux | E03F 7/04 |

* cited by examiner

*Primary Examiner* — Shay Karls
(74) *Attorney, Agent, or Firm* — Kyle R. Satterthwaite; Ryan W Dupuis; Ade & Company Inc.

(57) ABSTRACT

A drain cleanout features a flexible drain auger, a mounting section supported solely on a drain pipe, a drum section carried by the mounting section and storing the auger, a rotational connection coupling the mounting section and the drum section, and a rotational drive unit carried by the mounting section and operable to drive rotation of the drum section. A feed mechanism for the flexible auger features a helical slot in the auger cable and a thin disc received in the slot and supported at a fixed longitudinal position in a travel direction along which the drain auger exits and re-enters the drum. Rotation of the auger cable with the drum cause longitudinal displacement of the auger cable in the travel direction. A liquid sensor enables the apparatus to be left in place for automatic self-activation upon detection of liquid back up in the drain pipe.

12 Claims, 1 Drawing Sheet

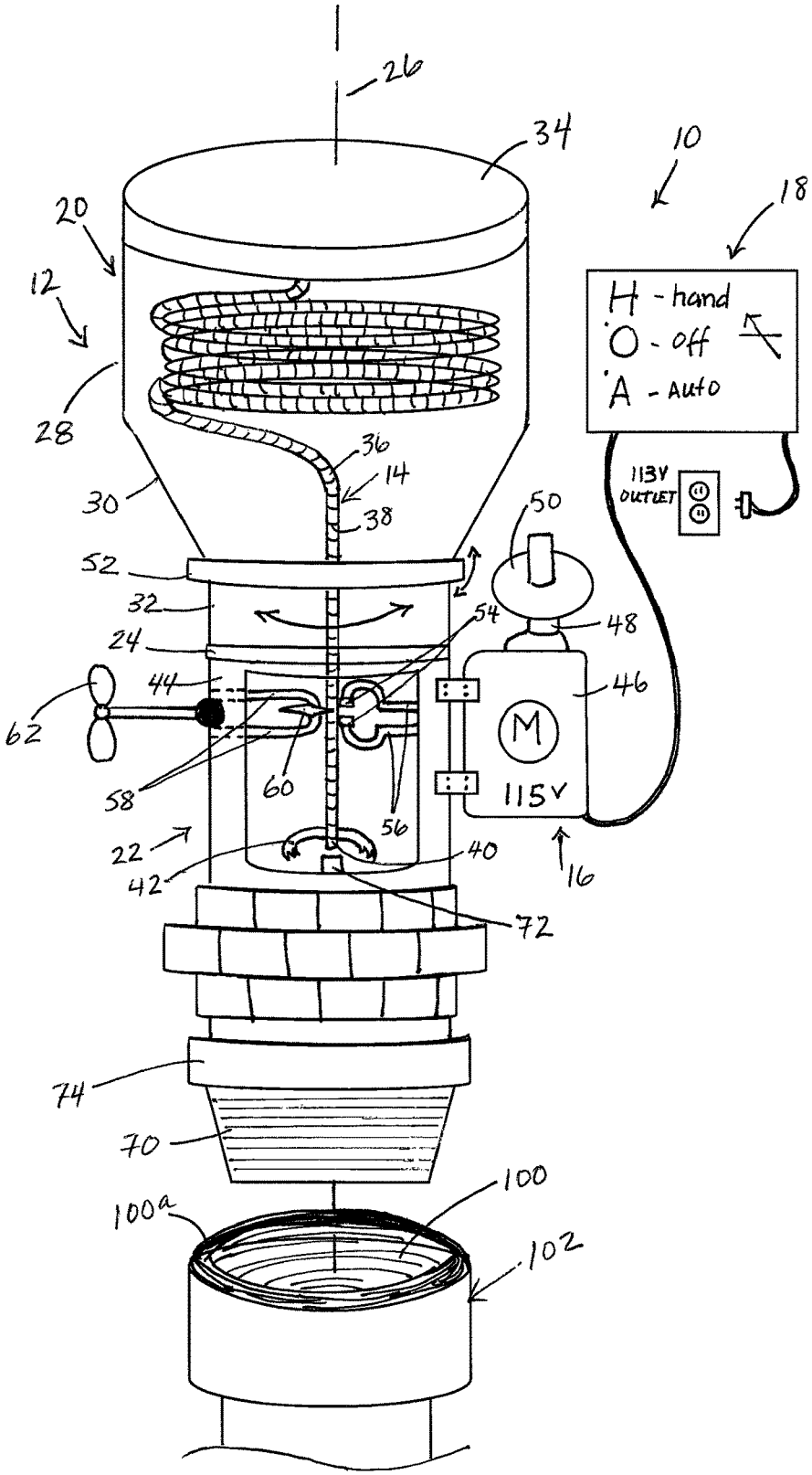
26
34
10
18
20
12
H - hand
O - off
A - auto
28
36
14
30
38
113V OUTLET
50
52
32
54
48
24
44
46
62
M
58
60
115V
56
22
40
42
16
72
74
70
100
100a
102

MOTORIZED PIPE-MOUNTED DRAIN CLEANOUT

CROSS REFERENCE TO RELATED APPLICATIONS

This application claims benefit under 35 U.S.C. 119(e) of Provisional Application Ser. No. 62/333,555, filed May 9, 2016, the entirety of which is incorporated herein by reference.

FIELD OF THE INVENTION

The present invention relates generally to clean out devices for removing obstructions from drainage pipes, and more particularly to a motorized cleanout apparatus mountable on a drainage pipe at cleanout access point thereon for automated cleanout operations.

BACKGROUND

Clearing of obstructions from drain pipes typically involves hiring a plumber or technician to clean out the obstruction using a drain auger, especially when the obstruction is quite substantial and consumer grade hand-powered drain augers are insufficient for the task, as the typical homeowner is unlikely to own or operate a heavier grade motor-driven unit. The need for professional services not only increases the cost involved in a drain cleanout operation, but can also lead to significant wait times for the consumer depending on the availability of services providers in the area. Customers may also be unlikely to schedule regular maintenance in view of the cost and/or inconvenience of seeking a professional service provider, thereby increasing the likelihood of more significant obstructions building up over time and leading to potential drain line backup, and associated property damage.

U.S. Pat. No. 4,376,321 discloses an automatic drain cleanout device in the form of a motorized, timer activated drain snake with a suitable fitting for attachment to a plumbing adapter between the drain trap of a sink and a vertical drain pipe. While this provides for improved plumbing maintenance via regular ongoing cleanout operations, this device lacks any means for retracting the drain snake, which therefore remains within the plumbing path at all times, reducing the available flow area within the pipes.

U.S. Pat. No. 4,388,741 teaches an automatic sewer cleaning system that similarly prevents clogs through regular timer-controlled cleanout operations, but again uses a cleanout cable that remains within the plumbing at all times.

Accordingly, there remains room for improved solutions in the field of automated drain cleanouts, in response to which Applicant has developed a unique drain cleanout apparatus.

SUMMARY OF THE INVENTION

According to a first aspect of the invention, there is provided a drain cleanout apparatus comprising:

an elongated flexible drain auger;

a mounting section configured for coupling to a drain pipe in a condition supporting the mounting section on said drain pipe;

a drum section carried by the mounting section, said drum section holding one end of the drain auger and being configured to store a substantial length of the flexible drain auger in a coiled storage condition within the drum section between uses of the drain cleanout apparatus;

a rotational connection coupling the mounting section and the drum section together in a manner enabling relative rotation therebetween about a longitudinal axis of the drum around which the substantial length of the flexible drain auger coils in the coiled storage condition; and a rotational drive unit carried by the mounting section and operable to drive rotation of the drum section relative to the mounting section in opposing directions, including a first rotational direction which deploys the flexible drain auger through the mounting section into the drain pipe, and a second rotational direction which retracts the flexible drain auger into the drum section for storage in the coiled storage condition.

Preferably the mounting section and the drum section cooperably form a singular housing closing entirely around the coiled storage condition of the drain auger and a hanging portion of the drain auger depending from the drum section into the mounting section.

Preferably the rotational drive unit comprises a motor having a motor housing attached to the mounting section in stationary relation thereto, and a rotational output operably coupled with the drum section to drive rotation thereof.

Preferably the motor housing is externally mounted to the mounting section, and the rotational output of the motor comprises a drive gear meshed with cooperating gear teeth carried externally on the drum section.

Preferably the drum section comprises a storage portion in which the drain auger resides in the coiled storage condition and a connection portion residing between the storage portion and the mounting section, the rotational output of the motor being operably coupled to the connection portion of the drum section, which is of smaller diameter than the storage portion of the drum section.

Preferably the mounting section comprises a feeding mechanism for causing extension of retraction of the drain auger into and from the drain pipe under driven rotation of the drum section.

Preferably the feeding mechanism comprises a thin disc supported inside the mounting section at a fixed longitudinal position in a travel direction of the drain auger through the mounting section, the thin disc engaging with an auger cable of the drain auger at a helical slot in said auger cable, whereby rotation of the auger cable by driven rotation of the drum section causes displacement of the auger cable due to engagement of the thin disc in the helical slot of the auger cable.

Preferably the feeding mechanism further comprises rollers embracing against a periphery of the auger cable at positions spaced around the auger cable from the thin disc.

Preferably there is a liquid detection sensor in the mounting section and a controller operably connected to said sensor and configured to automatically activate the drain cleanout apparatus in response to detected presence of backed-up liquid from the drain pipe.

Preferably the controller is configured to perform a cleanout procedure first operating the rotational drive unit a first directional mode rotating the drum section in the first direction to deploy the drain auger into the drain pipe to clear out potential blockages therein, and subsequently operate the rotational drive unit a second directional mode rotating the drum section in the second direction to retract the drain auger from the drain pipe.

Preferably the controller comprises a timer for controlled timing of one or more steps in the cleanout procedure, and is configured to use said timer to run the rotational drive unit in the first directional mode for first predetermined period of time known to deploy a predetermined length of the auger from the drum section for a predetermined operational speed of the rotational drive unit, before terminating the first directional mode of the rotational drive unit and activating the second direction mode thereof to retract the drain auger.

According a second aspect of the invention, there is provided a drain cleanout apparatus comprising:

an elongated flexible drain auger;

a rotatable drum configured to store a substantial length of the flexible drain auger in a coiled storage condition within the drum between uses of the drain cleanout apparatus;

a feeding mechanism mounted proximate an outlet of the rotatable drum for causing extension and retraction of the drain auger out of and back into the rotatable drum under rotation of the drum;

wherein the feed mechanism comprises a thin disc supported at a fixed longitudinal position in a travel direction in which the drain auger exits and re-enters the drum at the outlet thereof, the thin disc engaging with an auger cable of the drain auger at a helical slot in said auger cable, whereby rotation of the auger cable by driven rotation of the rotatable drum causes displacement of the auger cable in the travel direction due to engagement of the thin disc in the helical slot of the auger cable.

According a third aspect of the invention, there is provided a drain cleanout apparatus comprising:

an elongated flexible drain auger;

a rotatable drum arranged to store a substantial length of the flexible drain auger in a coiled storage condition within the drum between uses of the drain cleanout apparatus, and to deploy the drain auger into a drain pipe under rotation of the drum in a first direction;

a liquid detection sensor mounted or mountable in a position that is fluidly communicating or communicable with an interior of the drain pipe but is outside a normal flow path through said drain pipe such that liquid is only expected at said position in the event of a blockage causing a backup of liquid in said drain pipe;

a rotational drive unit operable in at least a first operational mode in which said rotational drive unit rotates the drum in first direction; and a controller connected to the water sensor and the rotational drive unit and configured to automatically activate the first operational mode of the rotational drive unit in response to detection of backed up liquid by said liquid detection sensor, whereby said detection of backed up liquid automatically deploys the drain auger into the drain pipe for clearing of said blockage.

According a third aspect of the invention, there is provided a method of cleaning out a drain line comprising, with a main housing of a motorized drain cleaning apparatus coupled to the drain line in a self-supporting and water-tight position opening into said drain line, operating a motor of said motorized drain cleaning to automatically deploy a flexible drain auger of said motorized drain cleaning apparatus from said main housing into said drain line, and automatically retract said flexible drain auger from said drain line back into said main housing.

BRIEF DESCRIPTION OF THE DRAWINGS

One embodiment of the invention will now be described in conjunction with the accompanying drawings in which:

FIG. 1 is a schematic elevational view of an automatic drain cleanout apparatus of the present invention.

DETAILED DESCRIPTION

The cleanout apparatus of the illustrated embodiment features a main housing 12, a flexible drain auger 14 contained within the housing, a rotational drive unit 16 mounted externally of the main housing 12, and an electronic controller 18 connected to the drive unit 16 for controlling operation thereof to perform cleanout operations on a drain line on which the apparatus is installed.

The main housing 12 is divided into two distinct sections, namely an upper drum section 20 and a lowering mounting section 22 disposed therebeneath. A bottom end of the drum section 20 is rotatably coupled to the top end of the mounting section 22 by a bearing, swivel joint other type of rotational connection 24 by which the drum section 20 can rotate relative to the mounting section 22 about a central longitudinal axis 26 shared by both sections. The majority of the main housing 12 is illustrated as being transparent in order to reveal internal components contained therein, but it will be appreciated that this is for illustrative purposes only, and the housing 12 may in actuality be opaque throughout, as the visibility of internal components is not necessary for the intended purpose of the invention.

The drum section 20 features a cylindrical storage portion 28 at the top end thereof, beneath which a tapered transition portion 30 joins up with a smaller cylindrical connection portion 32 at the bottom end of the drum section. The top end of the drum section is closed off by a cap 34, which may be removable to enable access to interior components of the main housing for inspection, service, or replacement of components as needed.

The drain auger 14 features an elongated flexible auger cable 36 which features a helical slot 38 spanning the full length thereof from one end of the cable to the other. A first stationary end of the cable 36 is attached to the drum section 20 of the main housing at the top end thereof. In a normal default state of the apparatus 10 between uses thereof, a substantial majority of the auger cable 36 is coiled up inside the storage portion 28 of the drum section 20 against the interior of the cylindrical circumferential wall thereof, while a second working end 40 of the auger cable 36 hangs down into the mounting section 22 along the central longitudinal axis 26 of the main housing 12 from an outlet opening of the drum section at the lower end thereof. The illustrated auger features cutting blades 42 at the working end 40 thereof for clearing tree roots or other hard obstructions from the main drain line of a building. However, it will be appreciated that other versions of the apparatus for lighter duty applications (cleanout and prevention of smaller indoor lines) may not require such aggressive cutting elements at the working end of the auger, and may employ other blockage clearing features.

The mounting section 22 features a generally cylindrical upper portion 44 whose exterior is of generally equal diameter as the cylindrical connection portion 32 of the drum section 20. The rotational drive unit 16 includes an electric motor whose motor housing 46 is attached to the exterior of the mounting section's upper portion 44 in a position such that the output shaft 48 reaches upwardly to the connection portion 32 of the drum section 20 at a distance radially outward therefrom. An output gear 50 fixed on the motor's drive shaft 48 meshes with a mating set of gear teeth 52 spanning circumferentially around the drum section's connection portion 32 at the exterior thereof. This engagement of the drive unit's output gear 50 with the drum section's corresponding gear teeth 52 enables driven rotation of the drum section 20 of the main housing by operation of the motor. The motor can be driven in either direction, thus enabling rotation of the drum section of the main housing in both directions about the central longitudinal axis. While the output gear 50 of the illustrated embodiment is directly affixed to the drive shaft of the motor, other embodiments may employ a gear train or other transmission between the motor shaft and the output gear to attain a desired rotational speed of the drum section of the main housing relative to the motor speed.

Inside the upper portion 44 of the mounting section 22 of the main housing, a set of rollers 54 are carried on the circumferential wall of this portion 44 by inwardly reaching supports 56. The supports 56 space the rollers 54 inwardly from the circumferential wall that the rollers reside in proximity to the central longitudinal axis 26 and abut against the outer periphery of the auger cable 36.

At a position circumferentially offset from the rollers 54 around the circumferential wall of this portion 44 of the main housing, another set of supports 58 reach inwardly from the circumferential wall, but carry a thin disc 60 instead of rollers. This disc 60 resides in a transverse plane through which the central longitudinal axis 26 passes, and the perimeter of the disc 60 lies in close proximity to the central longitudinal axis 26. The disc 60 is preferably supported for rotation about a rotational axis that lies normal to the plane of the disc, thereby forming a rotatable wheel. Ash shown, the disc/wheel may sharpen towards it perimeter, where the wheel reaches into the helical slot 38 of the hanging portion of the auger cable 36 that reaches downwardly past the disc and rollers on the central longitudinal axis 26. As a result, when this hanging portion of the auger cable is rotated about the longitudinal axis 26 of the main housing by rotation of the drum section 20 of the main housing 12, the engagement of the disc 60 within the helical slot 38 of the auger cable 36 causes axial displacement of this hanging portion of the auger cable, either upwardly or downwardly along the longitudinal axis 26 depending on the direction in which the drum section 20 is being rotated about the longitudinal axis.

The rollers 54 have rotational axes that lie parallel to either the rotation axis of the disc 60 or the longitudinal axis 26 of the housing. Frictional contact between the cable 36 and the rollers 54 causes the rollers 54 to rotate with the cable 36. The rollers 54 are positioned generally opposite the disc 60, whereby the rollers prevent the disc from simply pushing the hanging portion of the cable off of the central longitudinal axis 26. The rollers thus help keep the disc 60 engaged with the cable to maintain the cooperative state therebetween by which the cable is displaced when the drum section of the main housing is rotated by the rotational drive unit. The disc and rollers thus cooperate to define a feeding mechanism for conveying the auger cable back and forth in the longitudinal direction of the housing under motorized rotation of the drum section.

The disc supports 58 are attached to a thumbscrew 62 that is engaged in a threaded port in the wall of the mounting section's upper section, whereby the disc 60 can be retracted out of engagement with the auger cable by loosening the thumbscrew. This enables release thereof from the feeding mechanism, for example for inspection, service, cleaning, repair or replacement of any components of the auger or feeding mechanism. Afterward, with the auger cable hanging downwardly past the rollers on the longitudinal axis again, the thumbscrew 62 is re-tightened to force the disc back into engagement with the auger cable at the helical slot therein.

At the bottom end of the main housing 12, the mounting section 22 features an externally threaded coupling portion 70 for mating with an internally threaded cleanout port 100 of a drain pipe 102. For example, the threading coupling portion 70 may be a Male Iron Pipe (MIP) connection for mating with a Female Iron Pipe (MIP) connection often used at the cleanout port on the main drain line of a residential building. By threading the coupling portion 70 of the main housing to the drain line, the entire main housing and the rotational drive unit thereon are supported entirely by the drain line. All portions of the main housing are hollow, with their hollow interiors opening into one another at their upper and lower ends, and with their respective circumferential walls closing fully around their shared central longitudinal axis 26. Accordingly, with the cap 34 in place at the top end of the main housing, and with the coupling portion 70 at the bottom of the main housing threaded to the cleanout port of the drain line, the main housing is fully enclosed in a water tight manner.

Deployment of the auger from the drum by rotation thereof in a first direction by operation of the drive unit 16 in a first directional mode thus extends the auger out through the bottom end of the main housing and into the drain line, where the driven rotation of the auger during this deployment clears any obstructions reached by the working end of the auger inside the drain line due to the action of the cutting blades or other elements at the working end of the auger cable. Termination of this first direction of drum and auger rotation is followed by reversal of the motor direction, where operation of the drive unit in the second directional mode retracts the working end of the auger out of the drain line through the cleanout port, and back into the upper portion of the main housing's mounting section. Accordingly, no portion of the auger resides in the normal flow path of the drain line during inactive periods of the apparatus between cleanouts.

The controller 18 provides automated control of a full cleanout cycle, the first stage which involves operation of the drive unit in the first directional mode to deploy a substantial length of the auger cable from its coiled storage position in the drum to maximize the auger's reach within the drain line. Having reached this full deployment, the next stage of the cycle involves reversing the directional mode of the drive unit in order to retract the auger back into its fully stored position in which the substantially majority of the cable is wound up within the drum section, leaving only the working end of the auger cable hanging down into the mounting section of the main housing, without entering the actual drain pipe. The full cross-sectional area of the drain pipe's flow path thus remains open between cleanout cycles.

In one embodiment, the controller uses a timer to control the amount of deployment and retraction of the auger performed during the deployment and retraction stages of the cleanout cycle. That is, a manufacturer or installer knows the amount of time required to deploy a given unit length of auger for a given operational speed of the motor, and can accordingly program the timer to run for a predetermined period of time in each of the drive unit's directional modes to achieve the desired length of auger to be deployed and retracted. The timer used for this purpose is referred to herein as a 'run timer', in order to distinguish from other timer functions mentioned elsewhere herein. In another embodiment, other means for determining suitable timing of the different stages of the cleanout cycle may be used, for example using contact switches or sensors in the drum to detect when a desired amount of auger cable has been unwound/rewound in the drum, or using an encoder to monitor rotations of the drum and accordingly track the current deployed/undeployed status of the auger cable.

The controller also features an autotimer, which serves to perform a full cleanout operation at prescribed intervals, which may be user programmable or customizable by the installer or end-user. The illustrated embodiment also includes a user-triggered 'hand mode' of operation, as opposed to the timer-triggered 'scheduled mode' that performs scheduled cleanout operations at a prescribed interval. In 'hand mode', the user can actuate a control button or other input of the controller to initiate a full cleanout operation. For example, the control button may be a normally open toggle switch, which when closed serves as an 'on' command instructing the controller to initiate a cleanout operation, just as it would use expiry of the autotimer as an 'on' in the scheduled mode.

Another selectable mode of operation is an 'auto mode', which makes use of a liquid detection sensor 72 mounted within the hollow interior of the main housing, for example at the illustrated position in the mounting portion 22 of the main housing below where disc and rollers serve as a feeding mechanism for deploying and retracting the auger cable under rotation of the drum section. In the event of sufficient blockage in the drain line that causes backflow to rise up into the cleanout apparatus through the cleanout port, the sensor 72 detects the presence of this backed up liquid, and the change in the sensor's state serves as an 'on command' causing the controller to initiate and complete a cleanout cycle with the intent of clearing the blockage and enabling proper drainage of the backed up line. The placement of the sensor inside the main housing of the apparatus ensures it is situated well outside the normal flow path of the drain line itself, and therefore is not triggered under normal conditions, but rather only other backflow conditions indicative of a downstream obstruction.

Once the apparatus is installed on a drain line by mating of the externally threaded coupling portion 70 with the drain port 700 of the pipe 102 until a flange 74 above the threaded portion abuts the annular rim 100*a* of the pipe 102, the apparatus can be left in place on a permanent or semi-permanent basis. By mounting motor to the mounting section of the base that is coupled to the drain line in a stationary position, the need for a separate from or structure to hold the motor in a stationary reference plane relative to the rotating drum section of the housing is avoided, resulting in a one-piece, self-contained unit supported entirely by the drain line itself. The drain auger is fully contained and enclosed within the housing in its coiled storage condition, and the installed position of the main housing fully encloses the drain auger's entry and exit point to and from the drain line due to the threaded connection of the apparatus to the cleanout port of the drain line and the fully enclosed state of the main housing's interior.

The controller may be separately mountable or supportable, for example fastened to a wall or placed on a shelf or other nearby accessible location for more convenient access. The controller and motor may be mains powered, whether by hardwired connection or plug and socket connection, and may use suitable voltage transformers as required depending on the operational requirements of the selected motor and electronic control components. The electronic components may include use of a micro-controller whose inputs monitor for button-actuations or other user selections between the different operating modes and optional user-selection or customization of scheduled cleanout times or intervals, whose outputs are used to control suitable circuitry to activate and deactivate the motor in the required rotational directions.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A drain cleanout apparatus comprising:

an elongated flexible drain auger;

a mounting section configured for coupling to a drain pipe in a condition supporting the mounting section on said drain pipe;

a drum section carried by the mounting section, said drum section holding one end of the drain auger and being configured to store a substantial length of the flexible drain auger in a coiled storage condition within the drum section between uses of the drain cleanout apparatus;

a rotational connection coupling the mounting section and the drum section together in a manner enabling relative rotation therebetween about a longitudinal axis of the drum around which the substantial length of the flexible drain auger coils in the coiled storage condition; and a rotational drive unit carried by the mounting section and operable to drive rotation of the drum section relative to the mounting section in opposing directions, including a first rotational direction which deploys the flexible drain auger through the mounting section into the drain pipe, and a second rotational direction which retracts the flexible drain auger into the drum section for storage in the coiled storage condition.

2. The apparatus of claim 1 wherein the mounting section and the drum section cooperably form a singular housing closing entirely around the coiled storage condition of the drain auger and a hanging portion of the drain auger depending from the drum section into the mounting section.

3. The drain cleanout apparatus of claim 1 wherein the rotational drive unit comprises a motor having a motor housing attached to the mounting section in stationary relation thereto, and a rotational output operably coupled with the drum section to drive rotation thereof.

4. The drain cleanout apparatus of claim 3 wherein the motor housing is externally mounted to the mounting section, and the rotational output of the motor comprises a drive gear meshed with cooperating gear teeth carried externally on the drum section.

5. The drain cleanout of claim 3 wherein the drum section comprises a storage portion in which the drain auger resides in the coiled storage condition and a connection portion residing between the storage portion and the mounting section, the rotational output of the motor being operably coupled to the connection portion of the drum section, which is of smaller diameter than the storage portion of the drum section.

6. The drain cleanout of claim 1 wherein the mounting section comprises a feeding mechanism for causing extension of retraction of the drain auger into and from the drain pipe under driven rotation of the drum section.

7. The drain cleanout apparatus of claim 6 wherein the feeding mechanism comprises a thin disc supported inside the mounting section at a fixed longitudinal position in a travel direction of the drain auger through the mounting section, the thin disc engaging with an auger cable of the drain auger at a helical slot in said auger cable, whereby rotation of the auger cable by driven rotation of the drum section causes displacement of the auger cable due to engagement of the thin disc in the helical slot of the auger cable.

8. The drain cleanout apparatus of claim 7 wherein the feeding mechanism further comprises rollers embracing against a periphery of the auger cable at positions spaced around the auger cable from the thin disc.

9. The drain cleanout apparatus of claim 1 comprising a liquid detection sensor in the mounting section and a controller operably connected to said sensor and configured to automatically activate the drain cleanout apparatus in response to detected presence of backed-up liquid from the drain pipe.

10. The drain cleanout apparatus of claim 9 wherein the controller is configured to perform a cleanout procedure first operating the rotational drive unit a first directional mode rotating the drum section in the first direction to deploy the drain auger into the drain pipe to clear out potential blockages therein, and subsequently operate the rotational drive unit a second directional mode rotating the drum section in the second direction to retract the drain auger from the drain pipe.

11. The drain cleanout apparatus of claim 10 wherein the controller comprises a timer for controlled timing of one or more steps in the cleanout procedure, and is configured to use said timer to run the rotational drive unit in the first directional mode for first predetermined period of time known to deploy a predetermined length of the auger from the drum section for a predetermined operational speed of the rotational drive unit, before terminating the first directional mode of the rotational drive unit and activating the second direction mode thereof to retract the drain auger.

12. A method of cleaning out a drain line with the apparatus of claim 1, said method comprising, with the mounting section coupled to the drain line in a self-supporting position supported on and opening into said drain line, operating the rotational drive unit in the first rotational direction to automatically deploy the flexible drain auger into said drain line, and then in the second rotational direction to automatically retract said flexible drain auger from said drain line.

* * * * *